US009335732B2

(12) United States Patent
Nishi

(10) Patent No.: US 9,335,732 B2
(45) Date of Patent: May 10, 2016

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Takayuki Nishi, Fujisawa Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/483,035

(22) Filed: Sep. 10, 2014

(65) Prior Publication Data

US 2015/0110508 A1 Apr. 23, 2015

(30) Foreign Application Priority Data

Oct. 22, 2013 (JP) ..... 2013-219260

(51) Int. Cl.
*G03G 15/00* (2006.01)
*G03G 21/20* (2006.01)

(52) U.S. Cl.
CPC ..... *G03G 21/203* (2013.01); *G03G 15/5004* (2013.01)

(58) Field of Classification Search
USPC ..... 399/44, 69, 70, 97
See application file for complete search history.

(56) References Cited

U.S. PATENT DOCUMENTS

| | | | | |
|---|---|---|---|---|
| 5,530,523 | A * | 6/1996 | Kawabata | 399/44 |
| 6,604,461 | B1 * | 8/2003 | De Bock et al. | 101/211 |
| 2006/0222385 | A1 * | 10/2006 | Serita | G03G 21/203 399/44 |
| 2013/0322899 | A1 * | 12/2013 | Okada | 399/44 |
| 2014/0079458 | A1 * | 3/2014 | Seto et al. | 399/389 |

FOREIGN PATENT DOCUMENTS

JP 2002175000 A 6/2002

OTHER PUBLICATIONS

JP2002-175000 Machine Translation available from JPO website.*

* cited by examiner

*Primary Examiner* — Minh Phan
(74) *Attorney, Agent, or Firm* — Patterson & Sheridan, LLP

(57) ABSTRACT

According to an embodiment, provided is an image forming apparatus including a temperature sensor, a humidity sensor, and a control unit. The control unit determines whether an environment of the apparatus is a dew condensation environment, based on a temperature of the apparatus detected by the temperature sensor and humidity in the apparatus detected by the humidity sensor. The control unit turns ON a dew condensation preventing heater when determining that the environment of the apparatus is the dew condensation environment in a case where a main power source of the apparatus is in an OFF state or the apparatus is in a power saving mode.

9 Claims, 4 Drawing Sheets

IMAGE FORMING APPARATUS

CROSS-REFERENCE TO RELATED APPLICATION

This application is based upon and claims the benefit of priority from the prior Japanese Patent Application No. 2013-219260, filed on Oct. 22, 2013, the entire contents of which are incorporated herein by reference.

FIELD

In general, an embodiment described herein relates to a multi-function peripheral (MFP) image forming apparatus having a dew condensation prevention function.

BACKGROUND

In the related art, an image forming apparatus including a dew condensation prevention function has been practically used. For example, an electrophotographic image forming apparatus includes a dew condensation preventing control mode which turns ON an exclusive heater for dew condensation prevention to prevent a dew condensation when a main power source is in an OFF state or the apparatus is in a power saving mode such as a sleep mode.

However, the image forming apparatus is configured to continuously apply a current to the exclusive heater in the dew condensation preventing control mode. In the image forming apparatus, the current is continuously applied to the exclusive heater, and thus there is a tendency to consume wasteful power.

Further, the image forming apparatus uses a low-power heater as the exclusive heater, to which the current is continuously applied, so as to slowly warm up the inside of the apparatus in the dew condensation preventing control mode. Thus, the image forming apparatus has a tendency that the inside of the apparatus hardly warms up even in the dew condensation preventing control mode. Accordingly, in the image forming apparatus according to the related art, further dew condensation preventing measures are required.

DETAILED DESCRIPTION

Figure 1:
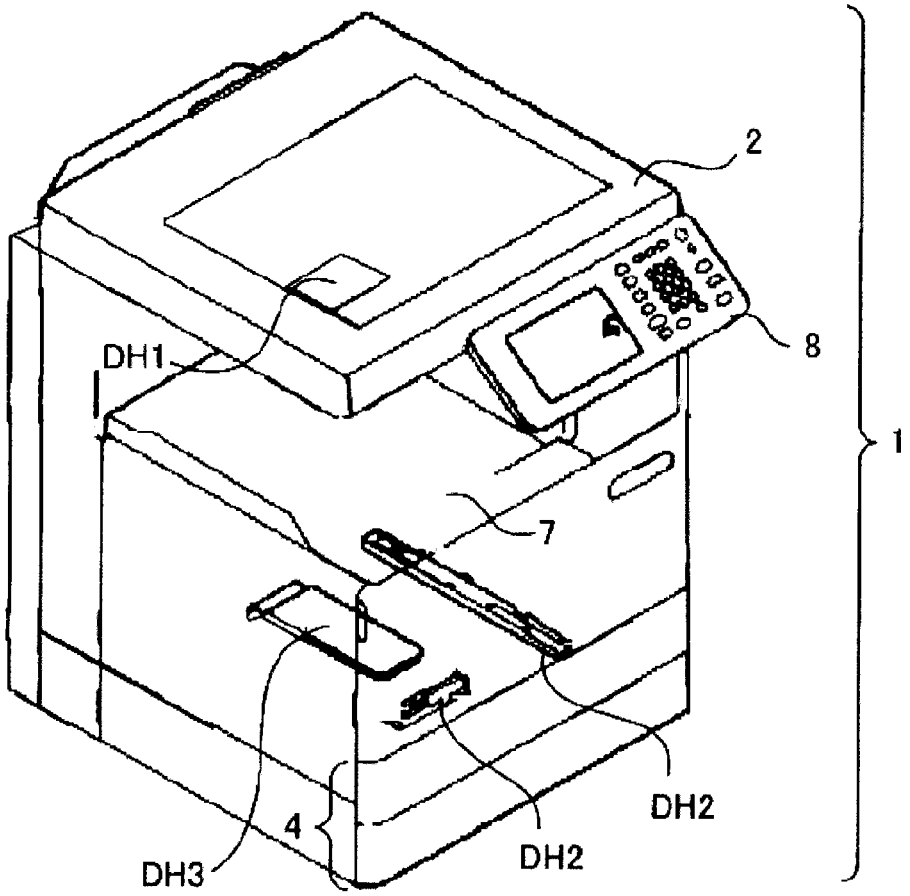
FIG. 1 is a perspective view illustrating an external appearance of an image forming apparatus according to a first embodiment.

According to an embodiment, an image forming apparatus having an image forming device for forming an image on a sheet and a dew condensation preventing heater is provided. The image forming apparatus further includes a temperature sensor, a humidity sensor, and a control unit. The temperature sensor detects an ambient temperature of the apparatus. The humidity sensor detects ambient humidity of the apparatus. The control unit controls current applying to the dew condensation preventing heater. Further, in the case where a main power source of the apparatus is in an OFF state or the apparatus is in a sleep mode, the control unit turns ON the dew condensation preventing heater when determining that an environment of the apparatus is in a dew condensation state based on detection information of the temperature sensor and the humidity sensor.

The embodiment will be described below in detail with reference with the drawings. In the drawings, the same reference numeral indicates the same or similar component.

Figure 2:
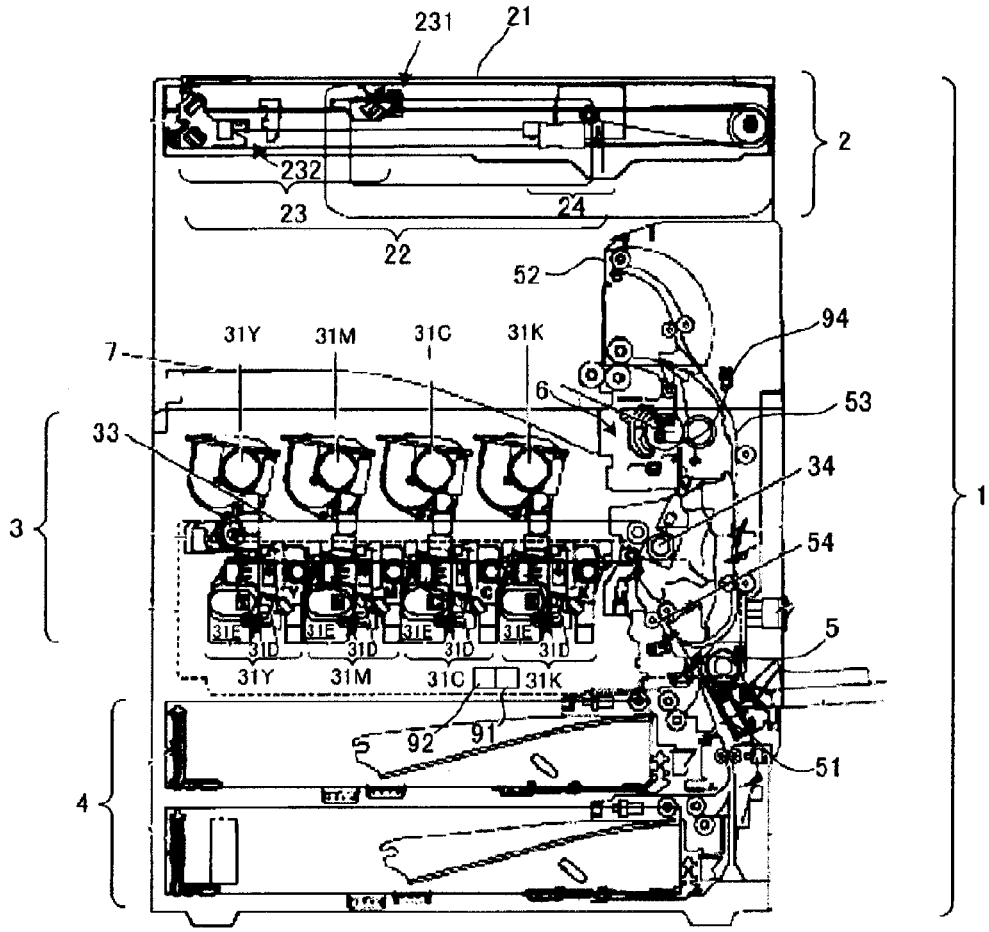
FIG. 2 is a cross-sectional view illustrating an internal structure of the image forming apparatus according to the first embodiment.

An image forming apparatus according to a first embodiment will be described with reference to FIGS. 1 and 2. FIG. 1 is a perspective view illustrating an external appearance of the image forming apparatus according to the first embodiment. FIG. 2 is a cross-sectional view illustrating an internal structure of the image forming apparatus according to the first embodiment.

An image forming apparatus 1 according to the first embodiment is, for example, an MFP. As illustrated in FIGS. 1 and 2, the image forming apparatus 1 includes a scanner device 2, an image forming device 3, a sheet feeding cassette unit 4, a sheet conveying unit 5, a fixing unit 6, a sheet discharging tray 7, and an operation unit 8, for example. The scanner device 2 is disposed at a top of a main body of the image forming apparatus. The image forming device 3 is disposed below the scanner device 2. The image forming device 3 forms a color image using electrophotography. The sheet feeding cassette unit 4 is disposed below the image forming device 3. The sheet feeding cassette unit 4 includes a sheet feeding cassette configured to accommodate sheets for forming an image and a sheet feeding roller configured to take out the sheet one by one from the sheet feeding cassette. The sheet conveying unit 5 conveys the sheet accommodated in the sheet feeding cassette unit 4 to an upper side (direction of the fixing unit 6) in FIG. 2. The fixing unit 6 heats and pressurizes an unfixed toner image held on the sheet to fix a toner image on the sheet. The sheet discharging tray 7 holds the sheet fixed with the toner image which is discharged outside the apparatus through the fixing unit 6.

The image forming device 3 includes a plurality of image forming units 31Y, 31M, 31C, and 31K having various colors, toner boxes 32Y, 32M, 32C, 32K for each color, an image exposure unit (not illustrated), a transfer belt 33, and a secondary transfer roller 34, for example. The image exposure unit has a light emitting diode (LED) or the like for exposing a photosensitive drum which will be described. Toner images of each color formed by each of the image forming units are primarily transferred onto the transfer belt 33. The transfer belt 33 carries the primarily transferred toner images and then conveys the toner images to a secondary transfer position of the secondary transfer roller 34. The secondary transfer roller 34 transfers the unfixed toner images carried on the transfer belt 33 at the secondary transfer position onto the sheet.

Each of the image forming units 31Y, 31M, 31C, and 31K includes a photosensitive drum 31D, and a developing device 31E. The photosensitive drum 31D is exposed by the image exposure unit, and thus an electrostatic latent image is formed thereon. The developing device 31E supplies the toner to the electrostatic latent image formed on the photosensitive drum 31D to develop the electrostatic latent image and thus the toner image is formed on the photosensitive drum 31D. Such a toner image is primarily transferred onto the transfer belt 33 by a primary transfer roller (not illustrated). As described above, the transfer belt 33 carries the toner images and then conveys the toner images to the secondary transfer position.

The sheet conveying unit 5 includes a main conveyance path 51, a resist roller 54, a sheet discharging roller 52, and a double-side conveyance path 53, for example. The main conveyance path 51 extends along a vertical direction at a right-side part inside the image forming apparatus in FIG. 2. In other words, the main conveyance path 51 extends from the position of the sheet feeding cassette unit 4 to the position of the fixing unit 6 via the secondary transfer position of the secondary transfer roller 34. Therefore, the main conveyance path 51 conveys the sheet taken out by the sheet feeding cassette unit 4 to the fixing unit 6 via the secondary transfer position. The resist roller 54 sends the sheet to the secondary transfer position in accordance with formation timing of the toner images. As described above, the secondary transfer roller 34 secondarily transfers the toner images onto the sheet. As illustrated in FIG. 2, the fixing unit 6 is disposed above the secondary transfer roller 34. The fixing unit 6 fixes the unfixed toner images on the sheet conveyed from the secondary transfer roller 34. The sheet discharging roller 52 is disposed above the fixing unit 6, as illustrated in FIG. 2. As described above, the sheet discharging roller 52 discharges the sheet, on which toner images are fixed, to the sheet discharging tray 7 outside the apparatus. At the time of forming an image on double sides of the sheet, the double-side conveying path 53 reverses one side of the sheet on which the toner images are fixed and then re-conveys the reversed sheet to the position of the resist roller 54. In FIG. 2, the fixing unit 6 is disposed at the right-side part of the main body of the image forming apparatus and the scanner device 2 is disposed above the fixing unit 6.

In the image forming apparatus 1, the scanner device 2 includes a document platen glass 21 and an image readout unit 22. The document platen glass 21 supports a document mounted by a user. The image readout unit 22 is disposed below the document platen glass 21. The image readout unit 22 reads out the image of the stationary document supported by the document platen glass 21. The image readout unit 22 includes a carriage 23 and a light receiving unit 24. In order to readout the image of the document, the carriage 23 is disposed so as to be movable in a sub-scanning direction (horizontal direction in FIG. 2) orthogonal to a main scanning direction. The light receiving unit 24 includes a charge-coupled device (CCD) line sensor on which image light, to be reflected through the carriage 23, of the document is incident. The carriage 23 includes a first carriage 231 and a second carriage 232. The first carriage 231 moves in the sub-scanning direction at a speed of V. The second carriage 232 moves in the sub-scanning direction at a speed of V/2. As illustrated in FIG. 2, the carriage 23 reciprocally moves between a home position located at a left end in the sub-scanning direction and a predetermined position opposite to the home position in the sub-scanning direction. In other words, one end of a movable range of the carriage 23 corresponds to the home position, and the other end of the movable range corresponds to the predetermined position. Hereinafter, the predetermined position is referred to as a moving terminal position. The home position is a position opposite to the fixing unit 6 and is a position apart from the fixing unit 6 in the image forming apparatus. The moving terminal position is a predetermined position toward the fixing unit 6 and is a position close to the fixing unit 6 in the image forming apparatus. The carriage 23 stands by at the home position before readout operation of the document image. The carriage 23 moves toward the moving terminal position from the home position at the start of the readout operation of the document image. The carriage 23 moves toward the home position from the moving terminal position and returns to the home position at the end of the readout operation of the document image.

The first carriage 231 includes an illumination light source (not illustrated) and a first reflective mirror (not illustrated). The illumination light source irradiates the document with the light. The first reflective mirror reflects the image light emitted from the document toward the second carriage 232. The second carriage 232 includes a second reflective mirror (not illustrated). The second reflective mirror returns the light reflected from the document by the first reflective mirror of the first carriage 231 and reflects toward light receiving unit 24.

Meanwhile, as illustrated in FIG. 1, the image forming apparatus 1 includes a scanner damp heater DH1, a drum damp heater DH2, and a belt damp heater DH3. The scanner damp heater DH1 is provided in the first carriage 231 and the second carriage 232 of the carriage 23. The scanner damp heater DH1 heats mirror surfaces of the first reflective mirror and the second reflective mirror to prevent the mirror surfaces from being misted by dew condensation. The drum damp heater DH2 is provided in proximity to the photosensitive drum 31D of the image forming device 3. The drum damp heater DH2 heats the photosensitive drum 31D to prevent occurrence of the dew condensation on the photosensitive drum 31D. The belt damp heater DH3 is provided in the vicinity of the transfer belt 33. The belt damp heater DH3 heats the transfer belt 33 to prevent occurrence of the dew condensation on the transfer belt 33. In addition to the carriage 23, the photosensitive drum 31D, and the transfer belt 33, the developing device 31E for storing the toner is disposed in the vicinity of the damp heaters DH1, DH2, and DH3. The damp heaters DH1, DH2, and DH3 are low-power heaters so as not to heat the developing device 31E for storing the toner to a high temperature.

Further, the image forming apparatus 1 includes a sensor for measuring an environment of the apparatus. The environment of the image forming apparatus 1 includes, for example, an ambient temperature inside the image forming apparatus 1. The environment of the apparatus includes, for example, an ambient humidity inside the image forming apparatus 1. The image forming apparatus 1 includes an in-apparatus temperature sensor 91 and an in-apparatus humidity sensor 92 as a sensor for measuring the environment of the apparatus. The in-apparatus temperature sensor 91 detects the ambient temperature inside image forming apparatus 1 as the environment of the apparatus. The in-apparatus humidity sensor 92 detects the ambient humidity inside image forming apparatus 1 as the environment of the apparatus. The in-apparatus temperature sensor 91 and the in-apparatus humidity sensor 92 are disposed at predetermined positions inside the image forming apparatus 1. As illustrated in FIG. 2, for example, the in-apparatus temperature sensor 91 and the in-apparatus humidity sensor 92 are provided in proximity to each other between the image forming device 3 and the sheet feeding cassette unit 4. Accordingly, the in-apparatus temperature sensor 91 detects the ambient temperature at the predetermined position inside the image forming apparatus 1, that is, at the position in the vicinity of the image forming device 3 and the sheet feeding cassette unit 4. The in-apparatus humidity sensor 92 detects the ambient humidity at the predetermined position inside the image forming apparatus 1, that is, at the position in the vicinity of the image forming device 3 and the sheet feeding cassette unit 4. The image forming apparatus 1 further includes an image-forming-unit temperature sensor 93 and a fixing-unit temperature sensor 94 (see FIG. 3). The image-forming-unit temperature sensor 93 detects a temperature of the image forming unit 31. The image-forming-unit temperature sensor 93 includes, for example, a temperature sensor for detecting a temperature of the photosensitive drum 31D and a temperature sensor for detecting a temperature of the transfer belt 33. The fixing-unit temperature sensor 94 includes, for example, a thermistor for detecting a heating temperature of the fixing unit 6.

Figure 3:
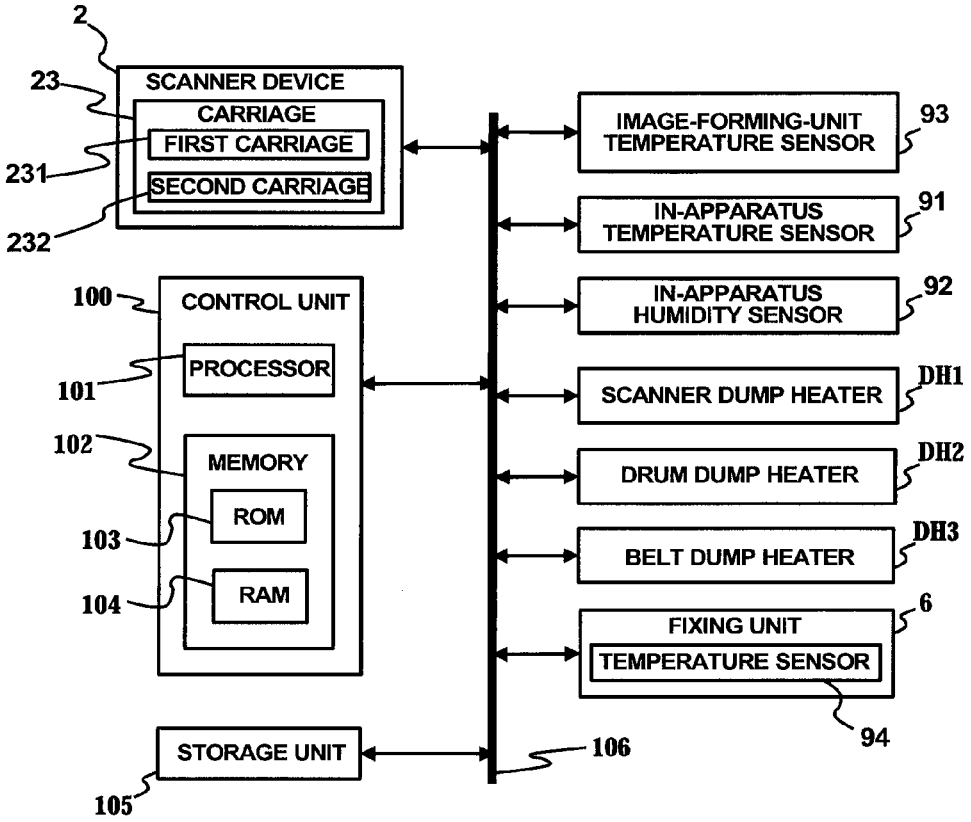
FIG. 3 is a block diagram illustrating a control configuration for dew condensation prevention of the image forming apparatus according to the first embodiment.

Hereinafter, a control configuration for dew condensation prevention of the image forming apparatus 1 will be described with reference to FIG. 3. FIG. 3 is a block diagram illustrating the control configuration for the dew condensation prevention of the image forming apparatus 1. A control unit 100 illustrated in FIG. 3 allows (ON) and blocks (OFF) the current applying to the scanner damp heater DH1, the drum damp heater DH2, and the belt damp heater DH3. The control unit 100 has a carriage-forced movement mode. When the main power source of the image forming apparatus 1 is in an OFF state or the image forming apparatus 1 is in a power saving mode such as a sleep mode state, the control operation of the control unit 100 shifts to the carriage-forced movement mode in a state where the dew condensation has occurred (dew condensation state) in the image forming apparatus 1 or in a state where the dew condensation is likely to occur in the image forming apparatus 1. In the carriage-forced movement mode, the control unit 100 controls driving of a driving motor (not illustrated) of the carriage 23 to move the carriage 23 to the moving terminal position and to stop the carriage 23 at the moving terminal position. A fixing heater of the fixing unit 6 has a larger heat capacity than the scanner damp heater DH1, the drum damp heater DH2, and the belt damp heater DH3. The carriage 23 stops at the moving terminal position and is held at the position close to the heater of the fixing unit 6. The heater of the fixing unit 6 rapidly warms the carriage 23 which is stopped at the moving terminal position (a position close to the fixing unit 6). Since the carriage 23 is warmed by the heater of the fixing unit 6, the dew condensation occurred on the reflective mirror of the carriage 23 is removed and the occurrence of the dew condensation on the reflective mirror is further prevented. In other words, for the removal of the dew condensation occurred on the reflective mirror of the carriage 23 and the prevention of the occurrence of the dew condensation, the fixing unit 6 warms the carriage 23.

As described above, each of the scanner damp heater DH1, the drum damp heater DH2, and the belt damp heater DH3 is the low-power heater. For this reason, even when the scanner damp heater DH1, the drum damp heater DH2, and the belt damp heater DH3 are turned ON, it is difficult to warm up the inside of the image forming apparatus 1. Since it is difficult to warm up the inside of the apparatus 1, it takes time to remove the dew condensation of the inside of the image forming apparatus 1. Accordingly, when the main power source of the image forming apparatus 1 is in the OFF state or the image forming apparatus 1 is in the power saving mode such as a sleep mode state, the control unit 100 turns ON the fixing heater of the fixing unit 6 in the state where the dew condensation has occurred in the image forming apparatus 1 or in the state where the dew condensation is likely to occur in the image forming apparatus 1. When the heater of the fixing unit 6 is turned ON, the temperature in the image forming apparatus 1 rapidly rises. The image forming device 3 in the image forming apparatus 1 is released from the dew condensation state when the temperature in the image forming apparatus 1 rises. Specifically, for example, the photosensitive drum 31D and the transfer belt 33 of the image forming device 3 are released from the dew condensation state. In addition, the dew condensation state of the carriage 23 is released. The control unit 100 turns OFF the heater of the fixing unit 6 when the carriage 23 and the image forming device 3 are released from the dew condensation state. Further, when the main power source of the image forming apparatus 1 is in the OFF state or the image forming apparatus 1 is in the power saving mode such as a sleep mode state, the control unit 100 turns ON the scanner damp heater DH1, the drum damp heater DH2, and the belt damp heater DH3 in the state where the dew condensation has occurred in the image forming apparatus 1 or in the state where the dew condensation is likely to occur in the image forming apparatus 1. When the scanner damp heater DH1, the drum damp heater DH2, and the belt damp heater DH3 are turned-ON by the control unit 100, the carriage 23, the photosensitive drum 31D, and the transfer belt 33 are heated. Even after the heater of the fixing unit 6 is turned OFF, the damp heaters DH1, DH2, and DH3 continuously heat the carriage 23, the photosensitive drum 31D, and the transfer belt 33 to further raise the temperature thereof. Even after the heater of the fixing unit 6 is turned OFF, the carriage 23, the photosensitive drum 31D, and the transfer belt 33 are maintained in the state where the dew condensation does not occur since the temperature thereof rises. In other words, even after the heater of the fixing unit 6 is turned OFF, the carriage 23, the photosensitive drum 31D, and the transfer belt 33 are maintained in the state where the dew condensation does not occur due to the continuous heating by the damp heaters DH1, DH2, and DH3. Even after the heater of the fixing unit 6 is turned OFF, the ambient temperature in the image forming apparatus 1 continuously rises due to the continuous heating by the damp heaters DH1, DH2, and DH3. When the ambient temperature in the image forming apparatus 1 rises until the environment in the image forming apparatus 1 becomes the state where the dew condensation does not occur, the control unit 100 blocks the current applying to the damp heaters DH1, DH2, and DH3.

For the dew condensation preventing measures, the heating temperature of the fixing unit 6 in the case where the heater of the fixing unit 6 is turned ON is a temperature different from the heating temperature (fixing temperature) of the fixing unit 6 in the case of fixing the toner images on the sheet. For the dew condensation preventing measures, for example, the heating temperature of the fixing unit 6 in the case where the heater of the fixing unit 6 is turned ON may be a lower temperature or a higher temperature than the fixing temperature. The ambient temperature in the image forming apparatus 1 in the case of blocking the current applying to each of the scanner damp heater DH1, the drum damp heater DH2, and the belt damp heater DH3 is the same temperature as described above, but may be different temperatures for each of the damp heaters.

As illustrated in FIG. 3, as the control configuration for performing the dew condensation prevention, the image forming apparatus 1 includes the control unit 100, the scanner damp heater DH1, the drum damp heater DH2, the belt damp heater DH3, the image-forming-unit temperature sensor 93, the fixing-unit temperature sensor 94, the in-apparatus temperature sensor 91, the in-apparatus humidity sensor 92, a storage unit 105, and the scanner device 2. The control unit 100 controls the entire of the image forming apparatus 1 in addition to the control for the dew condensation prevention. The units constituting the image forming apparatus 1 are connected to each other through a bus 106. The storage unit 105 stores an application program and an operation system (OS). The application program includes a program for executing a dew condensation prevention processing function. The application program further includes an application program (Web browser) for a Web client or other application programs. The storage unit 105 may be, for example, a hard disk drive or other magnetic storage devices, an optical storage device, a semiconductor storage device such as a flash memory, or any combination of these devices.

The control unit 100 has a processor 101 and a memory 102. The processor 101 includes a central processing unit (CPU) or a micro processing unit (MPU). The memory 102 is, for example, a semiconductor memory and has a read only memory (ROM) 103 and a random access memory (RAM) 104. The ROM 103 stores various control programs. The RAM 104 provides a temporary work area to the processor 101. Further, the ROM 103 stores a program for determining whether or not to be in the state where the dew condensation has occurred in the image forming apparatus 1 or whether or not to be in the state where the dew condensation is likely to occur in the image forming apparatus 1 and a program such as the carriage-forced movement mode. Based on the determination program stored in the ROM 103, the control unit 100 determines whether or not to be in the state where the dew condensation has occurred in the image forming apparatus 1 or whether or not to be in the state where the dew condensation is likely to occur in the image forming apparatus 1. Specifically, the control unit 100 determines whether or not to be in the state where the dew condensation has occurred in the image forming apparatus 1 or whether or not to be in the state where the dew condensation is likely to occur in the image forming apparatus 1, based on detection information on the environment of the image forming apparatus 1 detected by the sensor. More specifically, the control unit 100 determines whether or not to be in the state where the dew condensation has occurred in the image forming apparatus 1 or whether or not to be in the state where the dew condensation is likely to occur in the image forming apparatus 1, based on the temperature detected by the image-forming-unit temperature sensor 93, the in-apparatus ambient temperature detected by the in-apparatus temperature sensor 91, and the in-apparatus ambient humidity detected by the in-apparatus humidity sensor 92. Generally, when the ambient temperature is low and the ambient humidity is high, the dew condensation tends to easily occur in the image forming apparatus 1. Therefore, the control unit 100 determines whether or not to be in the state where the dew condensation has occurred in the image forming apparatus 1 or whether or not to be in the state where the dew condensation is likely to occur in the image forming apparatus 1, depending on whether the previously detected ambient temperature and humidity in the image forming apparatus 1 satisfy a predetermined relation with respect to the preset temperature and humidity. For example, the control unit 100 determines to be in the state where the dew condensation has occurred in the image forming apparatus 1 in the case of satisfying the relation in which the detected ambient temperature in the image forming apparatus 1 is equal to or lower than a preset first temperature and the detected ambient humidity in the apparatus is not less than a preset first humidity. Further, the control unit 100 determines to be in the state where the dew condensation is likely to occur in the image forming apparatus 1 in the case of satisfying the relation in which the detected ambient temperature in the apparatus is higher than the first temperature and the detected ambient humidity in the apparatus is lower than the first humidity and in which the detected ambient temperature in the apparatus is equal to or lower than a preset second temperature (second temperature>first temperature) and the detected ambient humidity in the apparatus is equal to or higher than a preset second humidity (second humidity<first humidity). Naturally, methods of determining whether or not to be in the state where the dew condensation has occurred in the image forming apparatus 1 or whether or not to be in the state where the dew condensation is likely to occur in the image forming apparatus 1 are not intended to be limited to the above.

Figure 4:
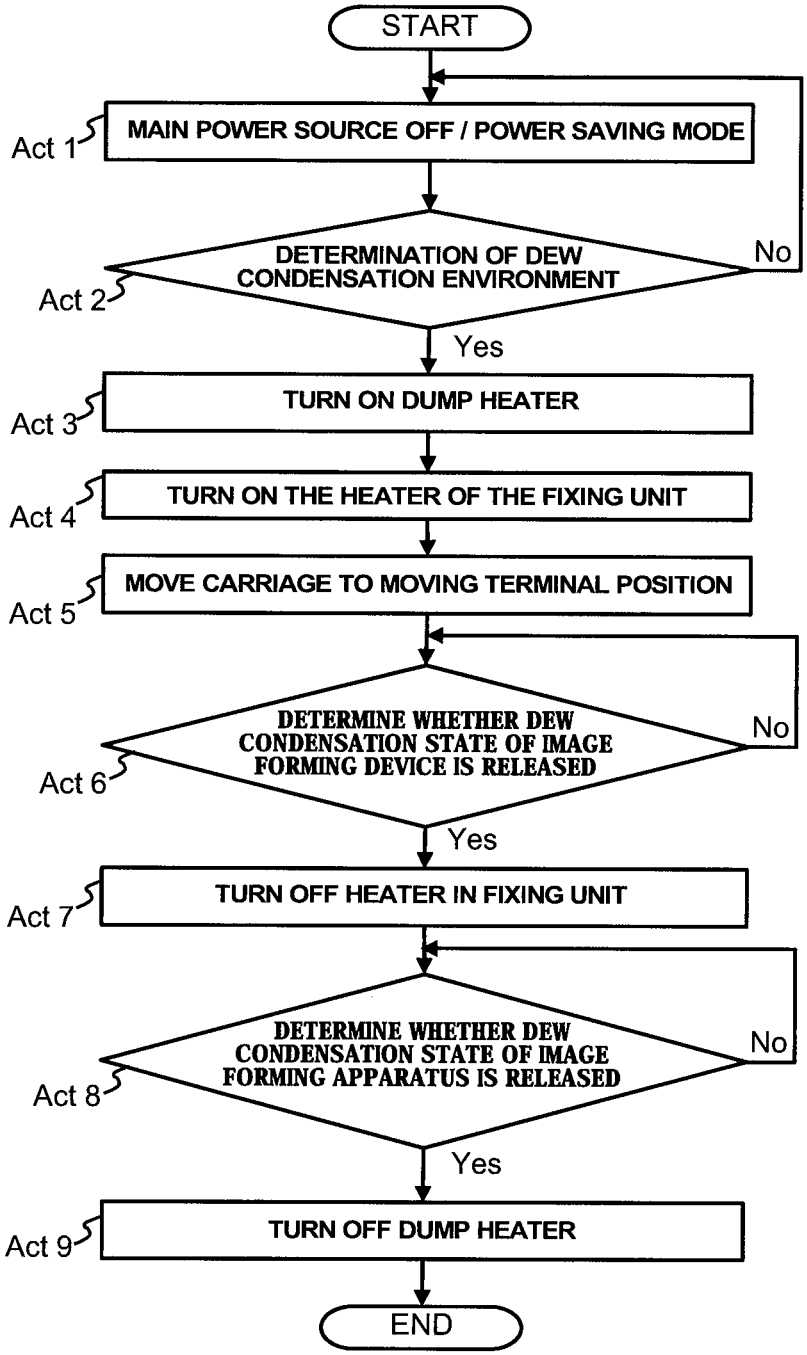
FIG. 4 is a flowchart for explaining a control operation for the dew condensation prevention of the image forming apparatus according to the first embodiment.

Hereinafter, the control operation for the dew condensation prevention using the control unit 100 will be described with reference to FIG. 4. FIG. 4 is a flowchart for explaining the control operation for the dew condensation prevention of the image forming apparatus 1.

In Act1 of FIG. 4, the control unit 100 determines that the main power source of the image forming apparatus 1 is in the OFF state or the image forming apparatus 1 is in the power saving mode such as the sleep state. When the main power source of the image forming apparatus 1 is in the OFF state or the image forming apparatus 1 is in the power saving mode such as the sleep state, the control operation of the control unit 100 proceeds to Act2.

In Act2, as described above, the control unit 100 determines whether or not to be in the state where the dew condensation has occurred in the image forming apparatus 1 or whether or not to be in the state where the dew condensation is likely to occur in the image forming apparatus 1, depending on the detection information of the in-apparatus temperature sensor 91, the in-apparatus humidity sensor 92, and the image-forming-unit temperature sensor 93. Hereinafter, the state where the dew condensation has occurred and the state where the dew condensation is likely to occur may be collectively called the dew condensation environment. When the control unit 100 determines that the inside of the image forming apparatus 1 is in the dew condensation environment, in other words, that the detection results of the sensors satisfy the conditions under which the dew condensation is likely to occur (Yes in the Act2), the control operation of the control unit 100 proceeds to Act3.

In Act3, the control unit 100 turns ON the scanner damp heater DH1, the drum damp heater DH2, and the belt damp heater DH3. After the control unit 100 turns ON each of the damp heaters, the control operation of the control unit 100 proceeds to Act4.

In Act4, the control unit 100 turns ON the heater of the fixing unit 6 as a heating source which warms up the inside of the image forming apparatus 1. The control unit 100 controls the heating temperature of the fixing unit 6 so as to be, for example, a temperature lower than the fixing temperature based on the detection temperature of the fixing-unit temperature sensor 94. By controlling the heating temperature of the fixing unit 6 to the temperature lower than the fixing temperature, it is possible to save the power of the image forming apparatus 1. After the control unit 100 turns ON the heater of the fixing unit 6, the control operation of the control unit 100 proceeds to Act5.

In Act5, the control unit 100 controls the carriage-forced movement mode. Specifically, the control unit 100 moves the carriage 23 of the scanner device 2 to the moving terminal position from the home position to stop the carriage 23 at the moving terminal position. Since the heater of the fixing unit 6 is turned ON in Act4, the ambient temperature in the image forming apparatus 1 is rising. Further, the moving terminal position is located above the fixing unit 6. For this reason, the carriage 23 stopped at the moving terminal position directly receives the heat raised by the heater of the fixing unit 6. Accordingly, the temperature of the carriage 23 and the ambient temperature in that vicinity reach a temperature at which the dew condensation does not occur, and the dew condensation or the mist on the reflective mirror of the carriage 23 is rapidly removed. Further, the humidity in the image forming apparatus 1 is reduced by the rising of the ambient temperature in the image forming apparatus 1. The control operation of the control unit 100 proceeds to Act6 when the carriage 23 of the scanner device 2 stops at the moving terminal position.

In Act6, the control unit 100 determines whether the dew condensation of the image forming device 3 is released. The control unit 100 determines whether the dew condensation of the image forming device 3 is released, based on the detection information of the in-apparatus temperature sensor 91, the in-apparatus humidity sensor 92, and the image-forming-unit temperature sensor 93. For example, when the difference between the ambient temperature in the image forming apparatus 1 detected by the in-apparatus temperature sensor 91 and the temperature detected by the image-forming-unit temperature sensor 93 is equal to or lower than a predetermined temperature and when the ambient humidity in the apparatus detected by the in-apparatus humidity sensor 92 is equal to or lower than a predetermined humidity, the control unit 100 determines that the dew condensation state of the image forming device 3 is released. When the control unit 100 determines that dew condensation state of the image forming device 3 is released, in other words, when the temperature of the image forming device 3 reaches the temperature at which the dew condensation does not occur (Yes in the Act6), the control operation of the control unit 100 proceeds to Act7.

In Act7, the control unit 100 turns OFF the heater of the fixing unit 6. In Act6, the dew condensation state of the image forming device 3 is released. Therefore, the control unit 100 determines that there is no need to forcedly raise the temperature in the image forming apparatus 1 any more by the heater of the fixing unit 6 and turns OFF the heater of the fixing unit 6. The control unit 100 turns OFF the heater of the fixing unit 6, thereby saving the power of the image forming apparatus 1. Even after the control unit 100 turns OFF the heater of the fixing unit 6, the control unit continuously turns ON the scanner damp heater DH1, the drum damp heater DH2, and the belt damp heater DH3. The scanner damp heater DH1, the drum damp heater DH2, and the belt damp heater DH3 maintains the temperature of the carriage 23 of the scanner device 2 and the temperature of the photosensitive drum and the transfer belt of the image forming device 3 at the temperature at which the dew condensation does not occur. Further, the control unit 100 continuously turns ON the damp heaters DH1, DH2, and DH3 to raise the ambient temperature in the image forming apparatus 1. After the control unit 100 turns OFF the heater of the fixing unit 6, the control operation of the control unit 100 proceeds to Act8.

In Act8, the control unit 100 determines whether the dew condensation state in the image forming apparatus 1 is released. Specifically, for example, the control unit 100 determines whether the dew condensation state in the image forming apparatus 1 is released, based on the information on the detection temperature of the in-apparatus temperature sensor 91 and the detection temperature of the image-forming-unit temperature sensor 93. When the control unit 100 determines that dew condensation state in the image forming apparatus 1 is released, in other words, when the ambient temperature in the image forming apparatus 1 reaches the temperature at which the dew condensation does not occur (Yes in the Act8), the control operation of the control unit 100 proceeds to Act9.

In Act9, the control unit turns OFF the scanner damp heater DH1, the drum damp heater DH2, and the belt damp heater DH3. In other words, since the inside of the image forming apparatus 1 is no longer in the dew condensation state, the control unit determines that the heating by the scanner damp heater DH1, the drum damp heater DH2, and the belt damp heater DH3 is not necessary anymore and turns OFF each of the damp heaters. The control unit turns OFF each of the damp heaters, thereby saving the power of the image forming apparatus 1. After the control unit turns OFF each of the damp heaters, the control operation for the dew condensation prevention of the control unit 100 is terminated. In Act8, as a determination element to be determined by the control unit 100 on whether the dew condensation state in the image forming apparatus 1 is released, the ambient temperature and the humidity in the image forming apparatus 1 are used, but environments outside the image forming apparatus 1 may be used as the determination element without being limited thereto. For example, an ambient temperature and humidity in a room in which the image forming apparatus 1 is installed may be used as the determination element. Further, during the control operation for the dew condensation prevention, the control unit 100 controls the image forming apparatus 1 to stop the operation of the image forming device 3. For example, during the control operation for the dew condensation prevention, when the image forming device 3 is operated, the transfer belt 33 or the photosensitive drum 31D, a stirring member for stirring the toner in the developing device 31E, and a developing roller rotate, and thus it takes time to warm up these members. Accordingly, the control unit 100 stops the operation of the image forming device 3 during the control operation for the dew condensation prevention to control each unit constituting the image forming device 3 to be warmed up as soon as possible.

By the way, the image forming apparatus according to the related art is configured to turn ON the dew condensation preventing heater when the main power source is in the OFF state or the apparatus is in the sleep mode. However, since the developing device or the toner is located at a position close to the dew condensation preventing damp heater provided to suppress the occurrence of the dew condensation on the photosensitive drum or the transfer belt, it may be impossible to make the damp heater to be a high temperature. Accordingly, the image forming apparatus according to the related art continuously turns ON the low-power damp heater as the dew condensation preventing heater to slowly warm up the inside of the image forming apparatus. Due to these influences, it takes along time until the temperature of photosensitive drum or the transfer belt warms up in the image forming apparatus according to the related art, and thus the image forming apparatus according to the related art consumes wasteful power.

In contrast, the image forming apparatus according to the present embodiment has the following configuration and performs the following control, and thus it is possible to, for example, achieve the power saving of the apparatus and to take the measures for preventing the dew condensation of the image forming apparatus by efficiently controlling the heater.

(1) The image forming apparatus includes the in-apparatus temperature sensor 91 and the in-apparatus humidity sensor 92, as the sensors for detecting the environments of the apparatus, which detect the ambient temperature and humidity in the apparatus, respectively.

(2) When the detection results of the sensors indicate the condition under which the dew condensation is likely to occur, the current applying is allowed to the scanner damp heater DH1, the drum damp heater DH2, and the belt damp heater DH3 which are the dew condensation preventing damp heaters, respectively.

(3) By simply applying the current to the dew condensation preventing damp heaters (the scanner damp heater DH1, the drum damp heater DH2, and the belt damp heater DH3), the image forming apparatus hardly warms up. Accordingly, first, the control unit turns ON the heater of the fixing unit 6, at least when the apparatus is in the state where the dew condensation is likely to occur. Further, the control unit moves the carriage 23 of the scanner device 2 to the position close to the fixing unit 6.

(4) The control unit blocks the current applying to the heater of the fixing unit 6 when the ambient temperature at and around the photosensitive drum 31D having a little trouble in case of occurrence of the dew condensation in particular, the transfer belt 33, and the scanner device 2 reaches the temperature at which the dew condensation does not occur.

(5) After the heater of the fixing unit 6 is turned OFF, the control unit maintains the temperature of the scanner device 2 and the image forming device at the temperature at which the dew condensation does not occur, using the dew condensation preventing damp heaters (the scanner damp heater DH1, the drum damp heater DH2, and the belt damp heater DH3).

(6) The control unit determines that the ambient temperature in the apparatus is the temperature at which the dew condensation does not occur and blocks the current applying to the dew condensation preventing damp heaters (the scanner damp heater DH1, the drum damp heater DH2, and the belt damp heater DH3).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming device configured to form an image on a sheet;

a fixing unit configured to fix the image formed on the sheet by heating the sheet with the image formed thereon to a fixing temperature;

a temperature sensor configured to detect an ambient temperature of the apparatus;

a humidity sensor configured to detect ambient humidity of the apparatus;

a scanner device configured to read an image on a document, the scanner device including a carriage moveable between a home position and a predetermined position near the fixing unit and above the fixing unit; and a control unit configured to:

determine whether an environment of the apparatus is a dew condensation environment, based on detection information of the temperature sensor and the humidity sensor, and when it is determined that the environment of the apparatus is the dew condensation environment, turn ON the fixing unit, control a heating temperature of the fixing unit to be lower than the fixing temperature, and control a movement of the carriage such that the carriage moves to the predetermined position.

2. An image forming apparatus comprising:

a scanner device configured to read an image on a document, the scanner device including a moveable carriage;

an image forming device configured to form an image on a sheet based on the image read by the scanner device;

a fixing unit configured to fix the image formed on the sheet by heating the sheet with the image formed thereon to a fixing temperature;

a temperature sensor configured to detect an ambient temperature of the apparatus;

a humidity sensor configured to detect ambient humidity of the apparatus; and a control unit configured to:

determine whether an environment of the apparatus is a dew condensation environment, based on detection information of the temperature sensor and the humidity sensor, and when it is determined that the environment of the apparatus is the dew condensation environment, turn ON the fixing unit and control a movement of the carriage such that the carriage moves to a predetermined position above the fixing unit.

3. The image forming apparatus according to claim 2, wherein the control unit turns ON the fixing unit and controls the heating temperature of the fixing unit when:

it is determined that the environment of the apparatus is the dew condensation environment, and a main power source of the apparatus is in an OFF state or the apparatus is in a power saving mode.

4. The image forming apparatus according to claim 2, wherein the control unit controls a heating temperature of the fixing unit to be lower than the fixing temperature when it is determined that the environment of the apparatus is the dew condensation environment.

5. The image forming apparatus according to claim 2, wherein the control unit maintains an image forming operation of the image forming device in a stop state when turning ON the fixing unit based on the determination that the environment of the apparatus is the dew condensation environment.

6. The image forming apparatus according to claim 2, further comprising:

a dew condensation preventing heater having a power requirement lower than that of the fixing unit, wherein the control unit turns ON the dew condensation preventing heater and subsequently turns ON the fixing unit when it is determined that that the environment of the apparatus is the dew condensation environment.

7. The image forming apparatus according to claim 6, wherein the image forming device is configured to:

form toner images on a photosensitive drum using electrophotography, primarily transfer the toner images onto a transfer belt from the photosensitive drum, and secondarily transfer the toner images from the transfer belt onto the sheet; and the dew condensation preventing heater includes:

a drum damp heater configured to heat the photosensitive drum to prevent occurrence of a dew condensation on the photosensitive drum, a belt damp heater configured to heat the transfer belt to prevent occurrence of a dew condensation on the transfer belt, and a scanner damp heater configured to heat the carriage of the scanner device to prevent occurrence of a dew condensation on the carriage.

8. The image forming apparatus according to claim 2, wherein the dew condensation environment is one of a first state in which a dew condensation has occurred in the apparatus and a second state in which a dew condensation is likely to occur in the apparatus.

9. The image forming apparatus according to claim 2, wherein:

the temperature sensor is positioned to detect an ambient temperature inside the apparatus, and the humidity sensor is positioned to detect an ambient humidity inside the apparatus.

* * * * *